US008963972B2

(12) United States Patent
Iguchi et al.

(10) Patent No.: US 8,963,972 B2
(45) Date of Patent: Feb. 24, 2015

(54) DECOLORING SYSTEM AND CONTROL METHOD OF DECOLORING SYSTEM

(71) Applicant: Toshiba Tec Kabushiki Kaisha, Tokyo (JP)

(72) Inventors: Ken Iguchi, Shizuoka (JP); Hidetoshi Yokochi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/788,746

(22) Filed: Mar. 7, 2013

(65) Prior Publication Data

US 2013/0242023 A1 Sep. 19, 2013

Related U.S. Application Data

(60) Provisional application No. 61/612,212, filed on Mar. 16, 2012, provisional application No. 61/612,211, filed on Mar. 16, 2012.

(51) Int. Cl.

| | |
|---|---|
| ***B41J 29/16*** | (2006.01) |
| ***B41J 11/00*** | (2006.01) |
| ***B41J 2/32*** | (2006.01) |

(52) U.S. Cl.

CPC *B41J 11/002* (2013.01); *B41J 2/32* (2013.01); *B41J 2202/37* (2013.01)

USPC ..... 347/179

(58) Field of Classification Search

USPC ..... 347/179, 171, 222

See application file for complete search history.

(56) References Cited

U.S. PATENT DOCUMENTS

| | | | | |
|---|---|---|---|---|
| 5,257,064 | A | 10/1993 | Okamoto | |
| 6,071,352 | A | 6/2000 | Sugie et al. | |
| 7,324,237 | B2 * | 1/2008 | Okada | 347/179 |
| 8,456,497 | B2 * | 6/2013 | Iguchi et al. | 347/179 |
| 2010/0118361 | A1 | 5/2010 | Iguchi | |
| 2010/0315475 | A1 * | 12/2010 | Taki et al. | 347/179 |
| 2011/0222130 | A1 | 9/2011 | Iguchi et al. | |
| 2012/0038732 | A1 * | 2/2012 | Iguchi et al. | 347/179 |
| 2012/0149562 | A1 | 6/2012 | Iguchi et al. | |
| 2012/0306982 | A1 | 12/2012 | Taki et al. | |
| 2012/0306985 | A1 | 12/2012 | Iguchi et al. | |
| 2013/0002783 | A1 | 1/2013 | Mizutani et al. | |
| 2013/0002784 | A1 | 1/2013 | Iguchi et al. | |

FOREIGN PATENT DOCUMENTS

| | | | |
|---|---|---|---|
| JP | 09146417 | A | 6/1997 |
| JP | 09244488 | A | 9/1997 |

* cited by examiner

*Primary Examiner* — Kristal Feggins

(74) *Attorney, Agent, or Firm* — Patterson & Sheridan LLP

(57) ABSTRACT

A decoloring system has a scanner that reads an image on a paper sheet and generates image data; a first roller that applies heat on the paper sheet to decolor the image on the paper sheet; a heater that heats the roller; a first transporting mechanism that transports the paper sheet having the image to the scanner; a second transporting mechanism that transports the paper sheet via the first transporting mechanism to the heater; an operation panel that receives a read condition of the image as input by a user; and a controller that determines an operating condition of the heater, and a transporting speed of the paper sheet by the first transporting mechanism and the second transporting mechanism on the basis of the image read condition input by the user through the operation panel.

20 Claims, 12 Drawing Sheets

*Fig. 5*

110

| First Resolution (dpi) | Second Resolution (dpi) | First reading velocity V1(mm/sec) | Erasing velocity VE(mm/sec) | Second reading velocity V2(mm/sec) |
|---|---|---|---|---|
| Non | 150/200 | 500 | 220 | 230 |
| 100 | 150/200 | 300 | 160 | 230 |
| 150 | 150/200 | 230 | 140 | 230 |
| 200 | 150/200 | 230 | 140 | 230 |
| 300 | 150/200 | 150 | 110 | 230 |

*Fig. 6*

111

| First Resolution (dpi) | First heater | Second heater | Third heater | Heat roller 60 temperature T1 (°C) | Heat roller 62 Temperature T2 (°C) |
|---|---|---|---|---|---|
| Non | ON | ON | ON | 175 | 160 |
| 100 | ON | ON | OFF | 165 | 150 |
| 150 | ON | ON | OFF | 160 | 145 |
| 200 | ON | ON | OFF | 160 | 145 |
| 300 | ON | ON | OFF | 155 | 140 |

112

| First Resolution (dpi) | First heater | Second heater | Third heater | Heat roller 60 temperature T1 (°C) | Heat roller 62 Temperature T2 (°C) |
|---|---|---|---|---|---|
| Non | ON | ON | OFF | 175 | 70 |
| 100 | ON | ON | OFF | 165 | 70 |
| 150 | ON | OFF | OFF | 160 | - |
| 200 | ON | OFF | OFF | 160 | - |
| 300 | ON | OFF | OFF | 155 | - |

DECOLORING SYSTEM AND CONTROL METHOD OF DECOLORING SYSTEM

CROSS-REFERENCE TO RELATED APPLICATION

This application is based upon and claims the benefit of priority from the prior U.S. Patent Application No. 61/612,211, filed on Mar. 16, 2012, and the prior the U.S. Patent Application No. 61/612,212, filed on Mar. 16, 2012; the entire contents of which are incorporated herein by reference.

FIELD

Embodiments described herein relate generally to a decoloring system for erasing a color of an image formed on each paper sheet and a control method of a decoloring system.

BACKGROUND

There have been developed recording or printing materials in which an image formed by the material may be erased by applying heat over a prescribed temperature to an image formed of the recording material. When such recording material is used to print on a sheet of paper, by applying heat on the image printed on the paper sheet, the paper sheet can be reused. However, in order to reuse the paper sheet, the color of the image should be erased to a state over a prescribed level of thoroughness, i.e., to a level at which the erased image is not readily apparent to the naked eye, and the paper sheet should not be damaged. In recent years, there has been developed a decoloring system with the function of erasing the color (including black and when on a colored paper sheet, white) formed on the paper sheet and the function of determination of whether the paper sheet can be reused.

DESCRIPTION OF THE DRAWINGS

FIG. 5 is a reference table illustrating a relationship between a resolution and a paper sheet transporting speed in the first embodiment.

FIG. 6 is a reference table illustrating a relationship between the resolution and a controlled temperature of a heating roller when the decoloring process is carried out for both sides of the paper sheet in the first embodiment.

DETAILED DESCRIPTION

Figure 1:
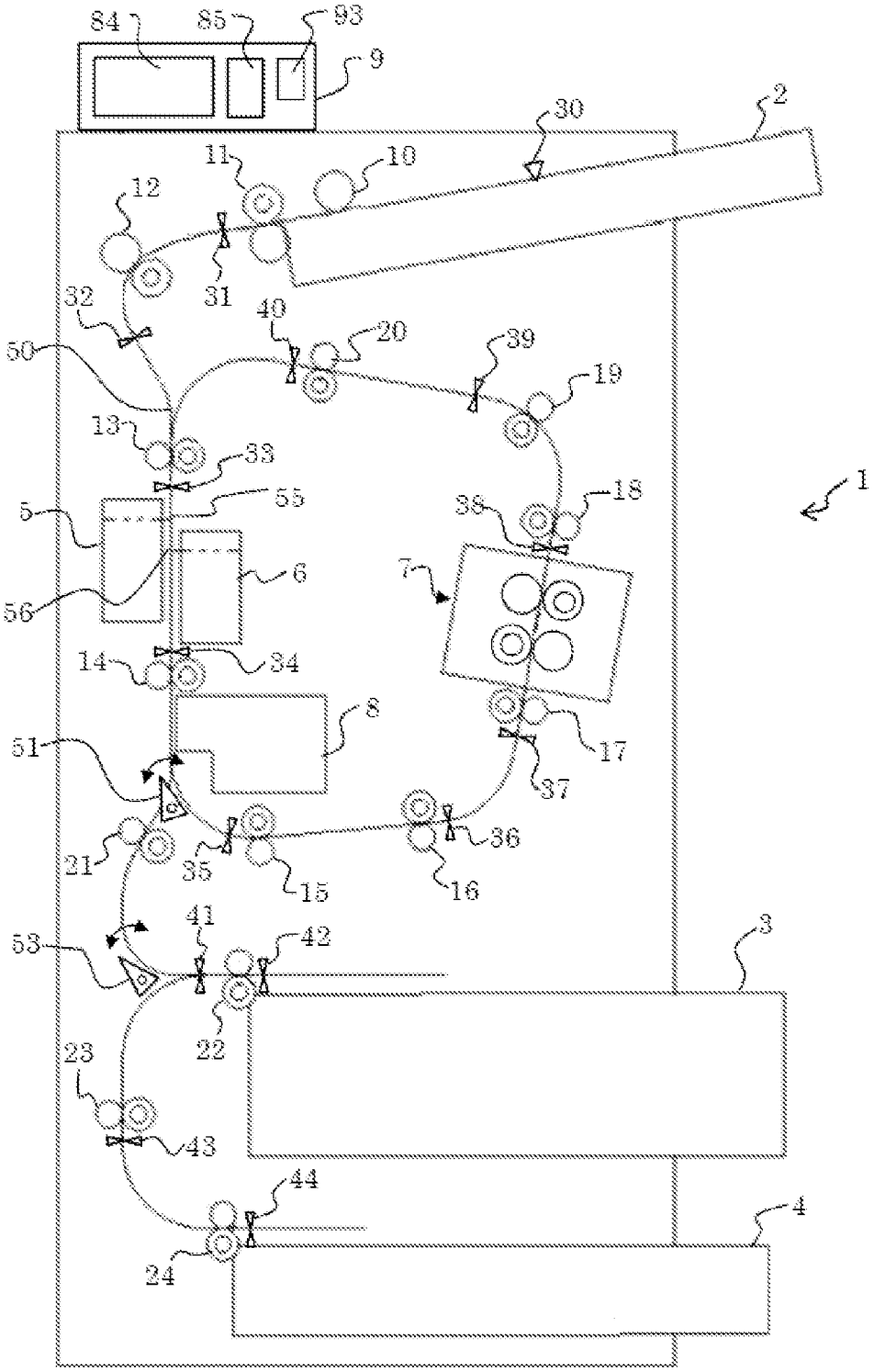
FIG. 1 is a diagram illustrating a configuration of a decoloring system in a first embodiment.

Hereinafter, further embodiments will be described with reference to the drawings. In the drawings, the same reference numerals denote the same or similar portions respectively.

In the following, a first embodiment will be explained with reference to FIGS. 1 to 11. FIG. 1 is a diagram illustrating a configuration of a decoloring system 1 of the first embodiment. Here, the decoloring system 1 uses a decolorable toner or decolorable ink or other "decolorable coloring material" to carry out "decoloring process" for a paper sheet (recording media) having an image formed on its surface. Here, the decoloring process is defined as a process for erasing the color of the image by the decolorable coloring material. The decolorable coloring material refers to a coloring agent, developing agent, or decoloring agent. An example of the coloring agent is a leuco dye. An example of the developing agent is one or more phenol. The decoloring agent is a substance that has mutual dissolving ability with the developing agent and has affinity to the coloring agent when heated. The decolorable coloring material is colored due to the interaction between the coloring agent and the developing agent. When heated to over the decoloring temperature, the interaction between the coloring agent and the developing agent deactivates, so that discoloration, or erasing, takes place. In the following, the decolorable coloring material will be referred to as recording material.

The decoloring system 1 contains a paper feeding tray 2, paper discharge trays 3, 4, scanners 5, 6, a decoloring unit 7, a printer 8, a paper transporting mechanism, and an operation panel 9. The paper transporting mechanism contains plural rollers, sensors and transporting passages. The transporting passage from a roller 11 to a merging point 50 is defined as a first transporting passage; the transporting passage from the merging point 50 to a gate 51 is defined as a second transporting passage; the transporting passage from the gate 51, via the decoloring unit 7, and returning to the merging point 50 is defined as a third transporting passage; the transporting passage from the gate 51 via a gate 53 to the paper discharge tray 3 is defined as a fourth transporting passage; and the transporting passage from the gate 53 to the paper discharge tray 4 is defined as a fifth transporting passage.

According to the first embodiment, pairs of rollers are provided on the transporting passages. Although not a necessity, one roller of a pair is a driving roller connected to a motor either directly or indirectly, while the other roller of a pair is a slave roller that is rotated following/by the diving roller or by the action of a sheet passing therethrough being driven by a driving roller. In the drawing, the diving roller is indicated by a double circle, i.e., a circle within a circle.

The paper feeding tray 2 accommodates the paper sheets to be processed for reuse. Here, the process for reuse is defined as a series of processing steps including the following functions: the function of acquisition of the image data of the paper sheet before the decoloring process, the function of decoloring the sheet, and the function of checking the state of, or completeness of, decoloration of the paper sheet. The paper feeding tray 2 has a sensor 30, a pickup roller 10, and a roller unit 11 (a pair of a driving and driven roller). The sensor 30 detects the presence/absence of a paper sheet in the paper feeding tray 2. The pickup roller 10 transports the paper sheet to the roller unit 11. The upper roller of the roller unit 11 is rotated in the direction for transporting the paper sheet toward the interior of the system, and the lower roller of the roller unit 11 is rotated in the direction opposite to that of the upper roller. Consequently, the roller unit 11 can transport the paper sheets one at a time.

In the first transporting passage, a paper sensor 31, a roller 12 and a paper sensor 32 are arranged in order from the upstream side in the paper transporting direction. The paper sensor detects whether there is a paper sheet at a detecting position of the sensor. The paper sensor is not limited to an optical sensor. It may also be a mechanical sensor, a sonic wave-type sensor, or the like.

In the second transporting passage, a roller 13, a paper sensor 33, the scanners 5 and 6, a paper sensor 34, a roller 14, the printer 8, and the gate 51 are arranged in order from the upstream side in the paper transporting direction. Here, the scanners 5, 6 each have an image sensor. The image sensor is, but is not limited to, a one-dimensional CCD line sensor. It may also be a two-dimensional CCD sensor. The image sensor receives the light emitted from a light source (not shown in the drawing) and reflected from the surface of the paper sheet. The image sensor detects the presence and location of an image on the sheet, as well as, wrinkles, holes, damage, etc. on the paper sheet and converts the detected information into an image data. The scanner 5 is arranged on the side opposite to the scanner 6, with the second transporting passage sandwiched between them. The scanner 5 generates the image data from side of the paper sheet at a reading position 55. The scanner 6 generates the image data from the other side of the paper sheet at a reading position 56. The decoloring system 1 can generate the image data from both sides of each paper sheet in a single pass of the paper sheet through the second transporting passage.

The printer 8 has the function for printing on one side of the paper sheet being transported. This printer 8 is, but is not limited to, an inkjet-type printer. It may also be of electrophotographic type or thermal type or the like. The ink is made of the recording material. The gate 51, located downstream in the paper transporting path from the printer, can switch the transported direction of the paper sheet to either the third transporting passage or the fourth transporting passage.

In the third transporting passage, a paper sensor 35, a roller 15, a roller 16, paper sensors 36, 37, a roller 17, the decoloring unit 7, a paper sensor 38, rollers 18, 19, a paper sensor 39, a roller 20, and a paper sensor 40 are arranged in order.

In the fourth transporting passage, a roller 21, the gate 53, a paper sensor 41, a roller 22, and a paper sensor 42 are arranged in order from the upstream side in the paper transporting direction. In the fifth transporting passage, a roller 23, a paper sensor 43, a roller 24, and a paper sensor 44 are arranged in order from the upstream side in the paper transporting direction.

The paper discharge trays 3 and 4 receive the paper sheets after the end of the decoloring process. For example, the paper sheets that can be reused are accommodated in the paper discharge tray 3, while the paper sheets that cannot be reused are accommodated in the paper discharge tray 4.

The operation panel 9 has a touch panel display 84, a tag reader 85, and a camera 93. Here, the touch panel display 84 is a graphical user interface (GUI), and it receives the user's instruction from the buttons, keyboard, etc. arranged in the GUI. The tag reader 85 reads the information from a non-contact IC tag. The user information can be read from an IC card held by the user. The tag reader 85 may contain a system for reading a magnetic stripe card. The camera 93 has a two-dimensional CCD image sensor, and it can recognize the one-dimensional or two-dimensional barcode or the like.

Figure 2:
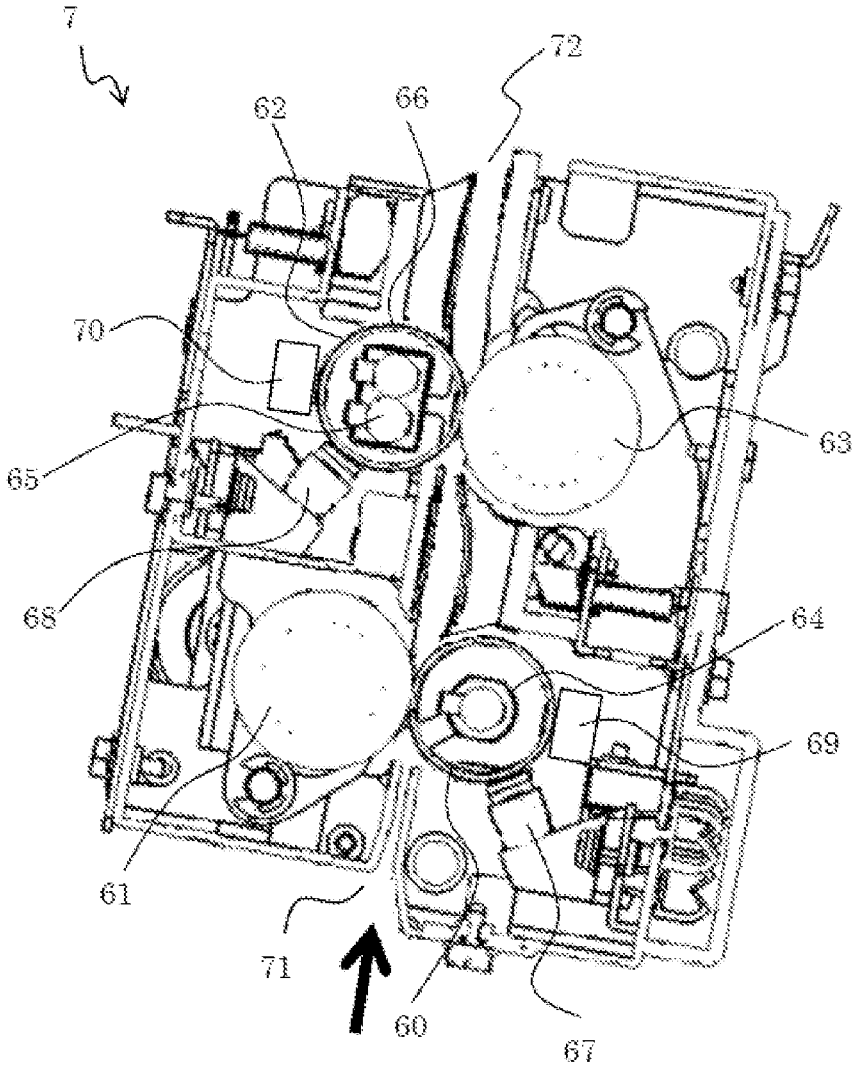
FIG. 2 is a diagram illustrating the configuration of the decoloring unit in the first embodiment.

FIG. 2 is a diagram illustrating the configuration of the decoloring unit. Here, the decoloring unit 7 has heating rollers 60, 62, pressing rollers 61, 63, a first heater 64, a second heater 65, a third heater 66, temperature sensors 67, 68, and thermostats 69, 70. The paper sheet enters through an inlet 71 into the decoloring unit 7, and it is discharged through an outlet 72. The arrow indicates the transporting direction of the paper sheet through the decoloring unit 7.

The heating rollers 60 and 62 are made of metal tubes. The heating roller 60 contains the first heater 64 inside it. The heating roller 62 contains the second heater 65 and the third heater 66 inside it. The first heater 64 is a halogen lamp heater with a nominal output power of 600 W. The second heater 65 and the third heater 66 each are a halogen lamp heater with nominal output power of 300 W. The heaters are not limited to the halogen lamp heaters. They may also be ceramic heaters or inductive heaters.

Pressing rollers are rollers made of a compliant material, for example, silicone rubber. The pressing roller 61 is arranged at the position in contact with the heating roller 60. The pressing roller 63 is arranged at the position in contact with the heating roller 62. As the heating roller and the pressing roller are rotated, the paper sheet is transported. The heating roller 62 is arranged on the downstream side in the paper transporting direction. The heating roller 60 heats on one side of the paper sheet, and the heating roller 62 heats on the other side of the paper sheet. That is, the heating roller 60 is arranged on the side opposite to the heating roller 62 with respect to the third transporting passage.

In contact with the surface of the heating roller 64, the temperature sensor 67 and the thermostat 69 are arranged. In contact with the surface of the heating roller 66, the temperature sensor 69 and the thermostat 70 are arranged. The temperature sensors 67 and 68 detect the surface temperature of the heating rollers 64, 66, respectively. The thermostats 69 and 70 cut off the power supply to any of the heaters 64 to 66 when the heating roller is heated to above a prescribed temperature level.

Figure 3:
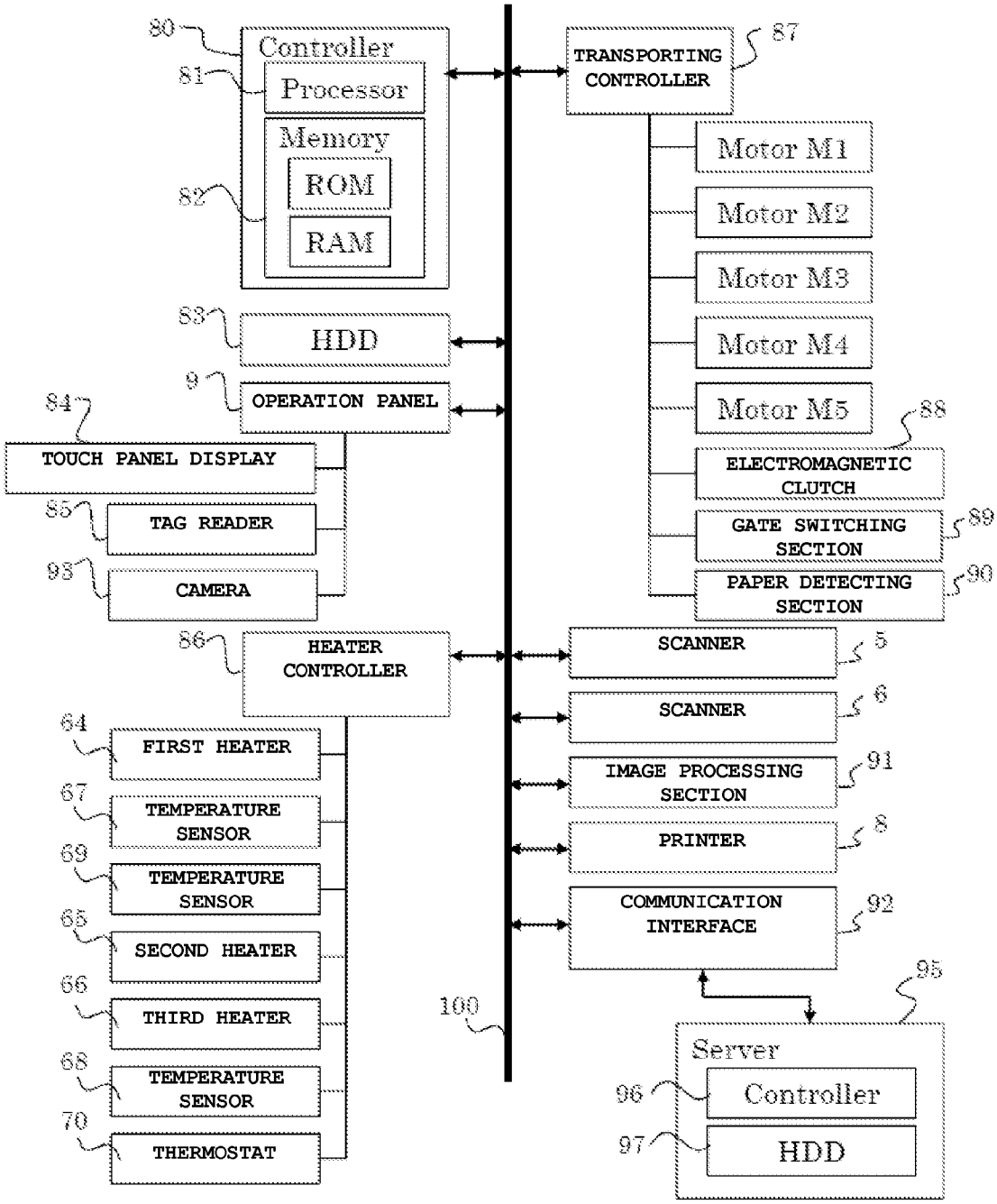
FIG. 3 is a block diagram illustrating functions of the decoloring system in the first embodiment.

FIG. 3 is a graph illustrating the function of the decoloring system. Here, a controller 80 of the decoloring system 1 has a CPU (central processing unit) or other processor 81 and a memory 82. The memory 82 contains ROM (read-only memory) and RAM (random access memory), etc. Here, the ROM is for storing the programs for controlling the controller 80. The RAM is for temporarily storing the programs and data files that can be used by the processor 81. The controller 80 is connected via a bus 100 to an HDD (hard disk device) 83, the operation panel 9, a heater controller 86, a transporting controller 87, the scanner 5, the scanner 6, an image processing section 91, the printer 8, and a communication interface 92, and it can carry out mutual communication with the devices.

The HDD 83 stores the image data generated by the scanner 5 and the scanner 6. One may also adopt a flash memory or other nonvolatile memory in place of the HDD. The operation panel 9 has the touch panel display 84, the tag reader 85, and the camera 93. The controller of the operation panel 9 controls the various devices according to the instructions from the controller 80.

The heater controller 86 is connected to the first heater 64, the second heater 65, the third heater 66, the temperature sensors 67, 68, and the thermostats 69, 70. Corresponding to the instructions from the controller 80 and the outputs of the various temperature sensors, the heater controller 86 controls the first heater 64, the second heater 65, and the third heater 66.

The transporting controller 87 controls the motors M1 to M5, an electromagnetic clutch 88, a gate switching section 89, and a paper feeding detecting section 90. The motors M1 to M5 provide driving forces to the plurality of rollers. The electromagnetic clutch 88 controls transmission of the driving force from the motor to the roller. The gate switching section 89 switches the stop positions of the gates 51 and 53. The paper feeding detecting section 90 receives the output from the paper sensors 30 to 44, and detects the position of the paper sheet in the decoloring system 1.

The image processing section 91 converts the image data generated by the scanner 5 and the scanner 6 to the image file in JPEG (Joint Photographic Expert Group), one of the image file formats, and stores them in the HDD 83. The image processing section 91 checks the state of the paper sheet from the image data, and determines whether the paper sheet can be reused. The image processing section 91 is Application Specific Integrated Circuit (ASIC). However, this is not exclusive. The programs for execution in the controller 80 are contained.

The communication interface 92 is connected to the decoloring system 1 and a server 95 via a Local Area Network (LAN), a Wide Area Network (WAN), or the like. The server 95 contains the controller 96 and an HDD 97. The server 95 receives the image data stored in the HDD 83 and has them stored in the HDD 97. Also, the server 95 receives from decoloring system 1 the read ID from the tag reader 85 and the camera 93, and, on the basis of the read ID, it sends the data to the decoloring system 1.

Figure 4:
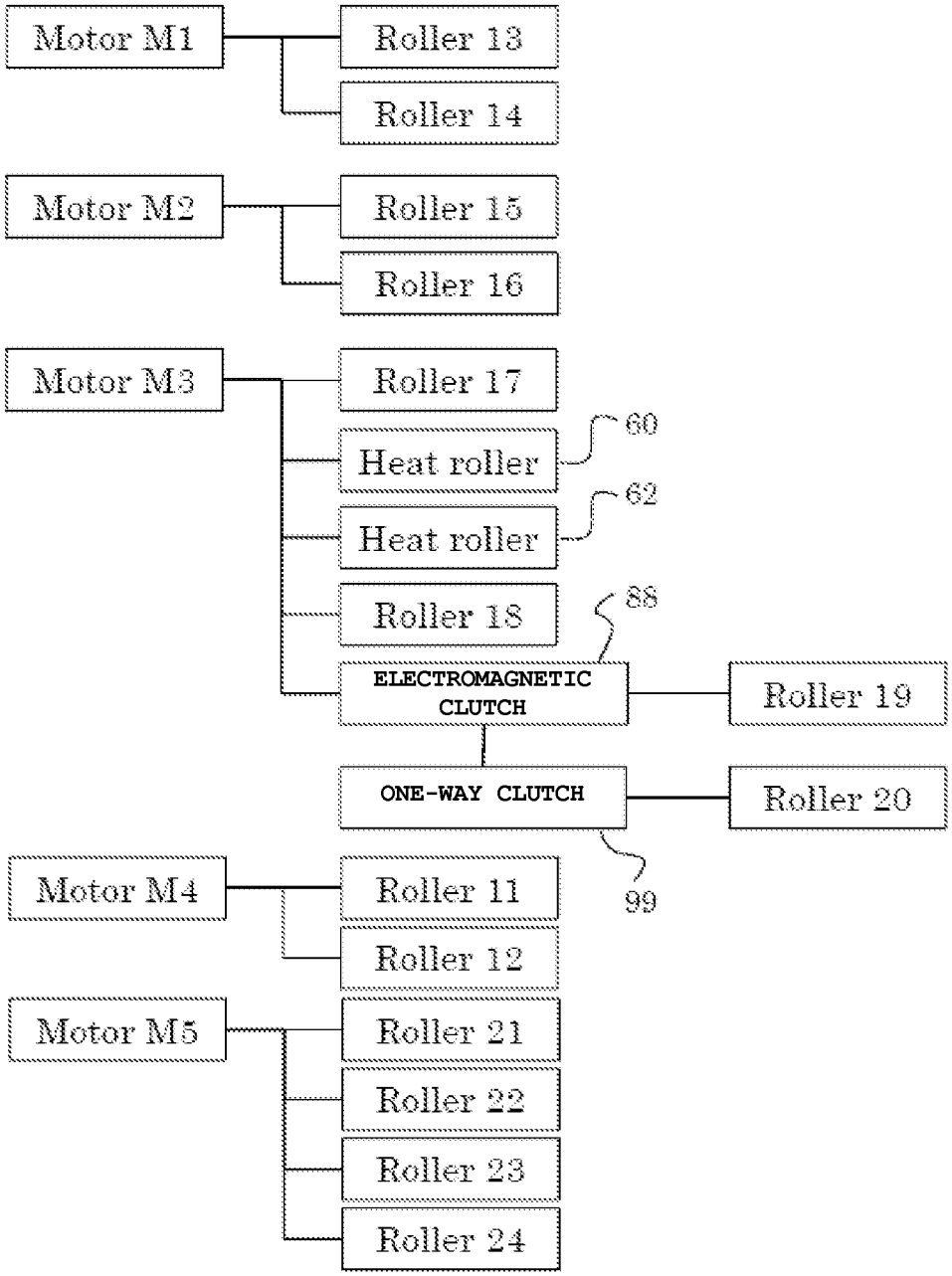
FIG. 4 is a diagram illustrating a configuration showing a mutual connection between a motor and rollers in the first embodiment.

FIG. 4 is a diagram schematically illustrating the configuration of the interconnection between the motors and the rollers. The motor M1 is connected to the rollers 13 and 14. The motor M2 is connected to the rollers 15 and 16. The motor M3 is connected to the roller 17, the heating rollers 60 and 62, the roller 18, and the electromagnetic clutch 88. The electromagnetic clutch 88 is connected to the roller 19 and the one-way clutch 99. The one-way clutch 99 is connected to the roller 20. When the motor M3 is driven to rotate, the transporting controller 87 controls the electromagnetic clutch 88, so that the rollers 19 and 20 can be stopped. The one-way clutch 99 idles when the rotation speed of the roller 20 is over a prescribed level. The motor M4 is connected to the rollers 11 and 12. The motor M5 is connected to the rollers 21 to 24.

FIG. 5 is a reference table illustrating the relationship between the resolution of imaging of a sheet passing through the scanners 5, 6 and the paper sheet transporting speed therethrough. For each value of a desired first scanning resolution, a speed reference table 110 defines a second resolution, a first read speed, an erasing speed, and a second read speed. The first resolution is the resolution set for the scanners 5 and 6 for storing the image data on the paper sheet. The user may use the operation panel 9 to select a first resolution. "NON" indicates that storage of the image is not carried out.

The second resolution is the resolution set for the scanners 5 and 6 for acquiring the image data of the paper sheet which was subject to decoloring process. The second resolution is a resolution for determining whether the paper sheet can be reused. According to the first embodiment, it is possible to select from two resolutions, that is, 150 dpi and 200 dpi. Corresponding to the precision of the determination on whether the paper sheet can be reused by the image processing section 91, the second resolution is set. As can be appreciated from the table, the first resolution may be greater than, or less than, the second resolution.

The first reading velocity V1 is the speed of a sheet provided by passing through the rollers associated with the motors M1 and M3 during scanning of the sheet when the scanners 5 and 6 generated the image data of the paper sheet at the first resolution. The erasing speed VE is the speed of the sheet provided by passing through the rollers associated with the motor M3 when the paper sheet is transported in the third transporting passage containing the decoloring unit 7. The second read speed V2 is the speed of a sheet provided by passing through the rollers associated with the motor M1 when the image data of the paper sheet are generated by the scanners 5 and 6 at the second resolution. As the first resolution is set to a higher value, the first read speed V1 and the erasing speed VE become lower. The erasing speed VE is lower than the first read speed V1 at all of values of the first resolution. At all of the values of the first resolution, the second read speed is set at a prescribed speed matching the second resolution.

FIG. 6 is a reference table illustrating the relationship between the resolution and then control temperature of the heating roller when the decoloring process is carried out for both sides of the paper sheet. A temperature reference table 111 is taken as reference by the controller 80 and the heater controller 86 when there is an instruction on execution of the decoloring process on both sides of the paper sheet. For each value of the first resolution, the temperature reference table 111 sets the ON/OFF information of first, second and third heaters, a control temperature T1 of the heating roller 60, and a control temperature T2 of the heating roller 62. At all of values of the first resolution, the control temperature T1 of the heating roller 60 is higher than the control temperature T2 of the heating roller 62. As the first resolution setting is increased, the control temperatures T1, T2 trend lower. This is for setting a lower erasing speed VE to match the first resolution. When the control temperatures T1 and T2 are high and the erasing speed VE is low, a heat quantity more than what required by the paper sheet is applied. As this heat warms the scanners 5 and 6, the scanners 5 and 6 become instable under the heat influence. According to this application example, the control temperature and the paper sheet transporting speed are selected to ensure that the decoloring process is carried out reliably without influence on the operation of the scanners 5 and 6.

The ON/OFF information of the heater is the information for setting whether the corresponding heater is on/off when the decoloring process is carried out. The heater controller 86 determines whether power is supplied to the first, the second and the third heaters in the decoloring process.

Figures 7, 8A:
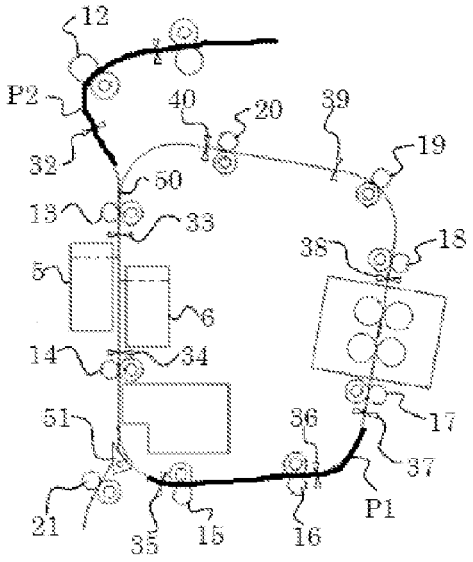
FIG. 7 is a reference table illustrating the relationship between the resolution and the controlled temperature of the heating roller when the decoloring process is carried out for one side of the paper sheet in the first embodiment.
FIGS. 8A to 8D are diagrams illustrating a transportation of the paper sheet represented in a time series in the first embodiment.

FIG. 7 is a table illustrating the relationship between the resolution and the control temperature of the heating roller when the decoloring process is carried out for one side of the paper sheet. A temperature reference table 112 is taken as reference by the controller 80 and the heater controller 86 when the user instructs execution of the decoloring process for one side of the paper sheet. For each value of the first resolution selected, the temperature reference table 112 sets the ON/OFF information of the first, second and third heaters, the control temperature T1 of the heating roller 60, and the control temperature T2 of the heating roller 62. When the first resolution is 150, 200, and 300 dpi, the second and third heaters are not turned on, and, as a result, the control temperature T2 is not set.

FIGS. 8A to 8D include diagrams illustrating transporting of the paper sheet shown in time series. As shown in FIG. 8A, a paper sheet P1 fed at the feeder (not shown) has passed through the first transporting passage and the second transporting passage, and was guided by the gate 51 to the third transporting passage and is positioned for entry into the decoloring unit. The motors M1 and M2 drive the rollers 13-16 to move the paper sheet at a first reading velocity V1. The motor M3 drives the rollers 17, 18, 60 and 62 to move a paper sheet at the erasing speed VE. As the paper sheet P1 is transported, the scanners 5 and 6 acquire the images on the two sides of the paper sheet P1 at the first resolution. As the front end of the paper sheet Plabout to enter the decoloring unit is detected by the sensor 37, the motor M2 drives the rollers to move the paper sheet at the erasing speed VE. The rollers 15 and 16 transport the paper sheet P1 to the decoloring unit 7. A second sheet P2 is shown positioned before the merging point 50. At the time when the trailing end of the paper sheet P1 passes the paper sensor 34, the paper sheet P2 is transported from the first transporting passage to the second transporting passage.

Figure 8B:
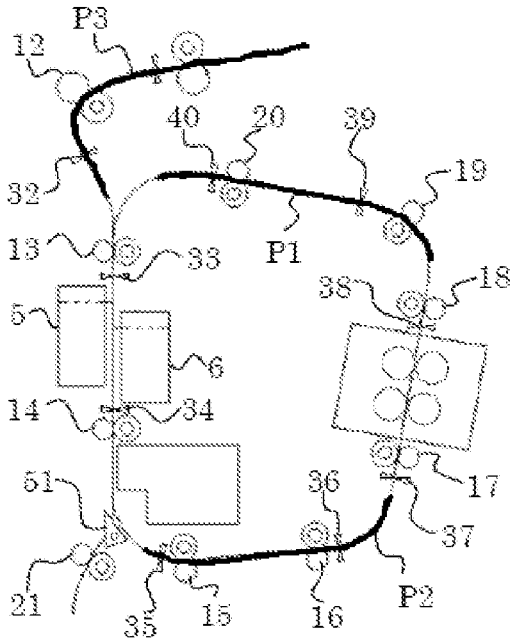

As shown in FIG. 8B, the paper sheet P1 has passed the decoloring unit 7, and it is transported in the third transporting passage at the erasing speed VE until the front end thereof is detected by the paper sensor 40. After reading of the image data by the scanners 6 and 7 and until the front end of the paper sheet P2 is detected by the sensor 37, the paper sheet P2 is transported at the first read speed V1. At the time point when the front end of the paper sheet P1 is detected by the paper sensor 40, the transporting controller 87 checks whether the paper sheet P2 is not detected by the sensors 33 and 34. When the paper sheet P2 is detected by the sensors 33 and 34, the transporting controller 87 turned off the electromagnetic clutch 88, so that movement of the rollers 19 and 20 is stopped. When the paper sheet P2 is not detected by the sensors 33 and 34, the motor M1 has the speed changed so that the transporting speed of the sheet driven by the rollers 13 and 14 becomes the second read speed V2. The paper sheet P3 is held before the merging point 50.

Figure 8C:
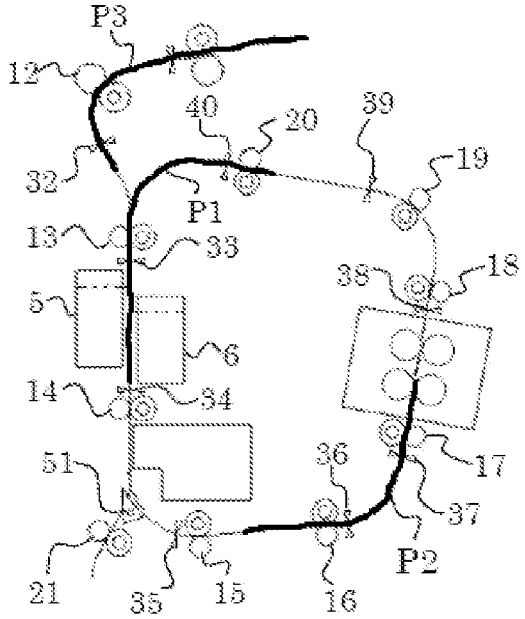

As shown in FIG. 8C, when the sensors 33 and 34 do not detect the paper sheet P2, the transporting controller 87 turns on the electromagnetic clutch 88, and the paper sheet P1 is transported at the erasing speed VE to the second transporting passage. As the front end of the paper sheet P1 enters the roller 13, the paper sheet P1 is transported at the second read speed V2. Because the second read speed V2 is higher than the erasing speed VE, the roller 20 is rotated at a speed higher than the erasing speed VE. The power from the motor M3 to the roller 20 is cut off by the one-way clutch 99, so that the roller rotates while idling, i.e., while not being actively driven by the motor M3. The scanners 5 and 6 generate the image data of the paper sheet P1 at the second resolution. The paper sheet P2 is transported at the erasing speed VE to the decoloring unit 7. The paper sheet P3 stands by before the merging point 50. The gate 51 is set at the position for guiding the paper sheet P1 to the fourth transporting passage.

Figure 8D:
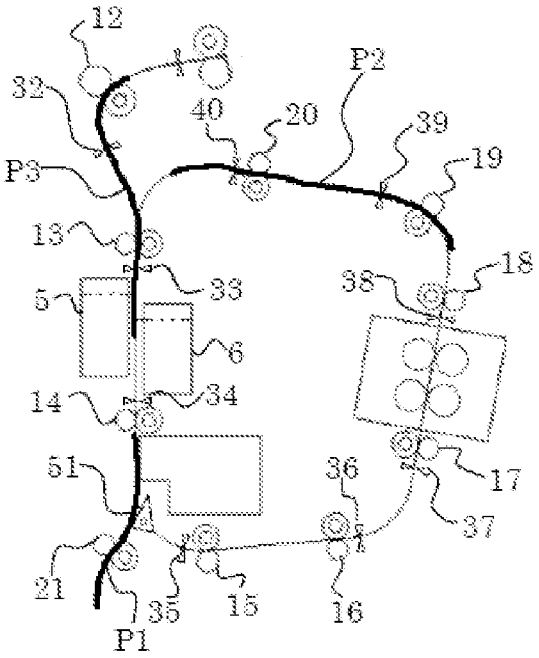

As shown in FIG. 8D, when the rear end of the paper sheet P1 is detected by the paper sensor 34, the transporting controller 87 controls so that the transporting speed of the rollers 13 and 14 becomes the first read speed V1. As the front end of the paper sheet P1 is detected by the paper sensor 41 or the paper sensor 43, the gate 51 is set at the position for guiding the paper sheet to the third transporting passage, and the paper sheet P3 is transported to the second transporting passage. At this time, the paper sheet P3 is sequentially detected by the sensors 33 and 34. When the front end of the paper sheet P2 is detected by the paper sensor 40, the transporting controller 87 turns off the electromagnetic clutch 88, so that the rollers 19 and 20 are stopped. When the first guided portion 34 does not detect the paper sheet P3, the transporting controller 87 turns on the electromagnetic clutch 88, so that the paper sheet P2 is transported into the second transporting passage. Then, until the reuse process ends for all of the paper sheets, the sequence of operation is continued.

Figure 9:
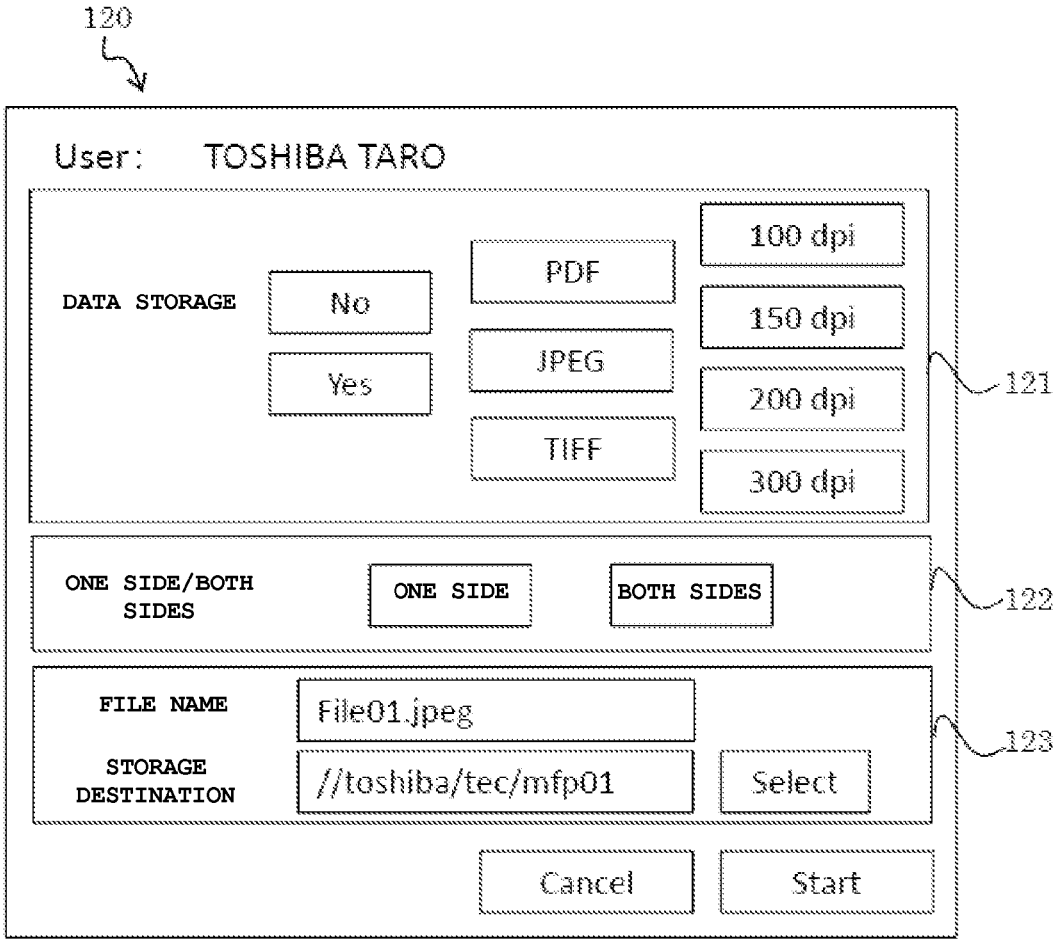
FIG. 9 is a diagram illustrating a configuration of a screen image for setup by a user in the first embodiment.

FIG. 9 is a diagram illustrating a configuration of a setup screen image adopted by the user. A setup screen image 120 is generated by the controller 80, and it is displayed on the touch panel display 84. Several buttons on the setup screen image 120 can be selected by the user. The controller 80 receives the result of the selection by the user, and carries out the reuse process. The user uses the touch panel display 84, the tag reader 85 or the camera 93 to log in the decoloring system 1. When the user is a prescribed user, the user name is displayed on the setup screen image 120.

The setup screen image 120 contains a region 121, a region 122, and a region 123. The region 121 is provided for storage of the data, and it has YES button and NO button indicating the presence of the instruction of storage of the image data. When the user selects the YES button, it indicates that it is possible to select several resolutions and the storage format of the image data. As the initial value, the setup screen image 120 for which the YES button is selected is displayed on the touch panel display 84. This initial value executes the decoloring process for the paper sheet so that it works efficiently when the user fails to check up the setup.

The region 122 is provided for selecting one side or both sides of the paper sheet. Corresponding to the button selected by the user, the heater controller 86 selects either of the reference table 111 or 112. The region 123 is a region for assigning an address and file name for storage of the image data generated by the scanners 5 and 6. The user can directly input the address of the HDD 83, the HDD 97 in the decoloring system 1, and the HDD in the other network. The user can use the select button to assign the address easily.

The start button is a button for initiating the reuse process. The cancel button has the function for resetting the content selected by the user to the initial value.

Figure 10:
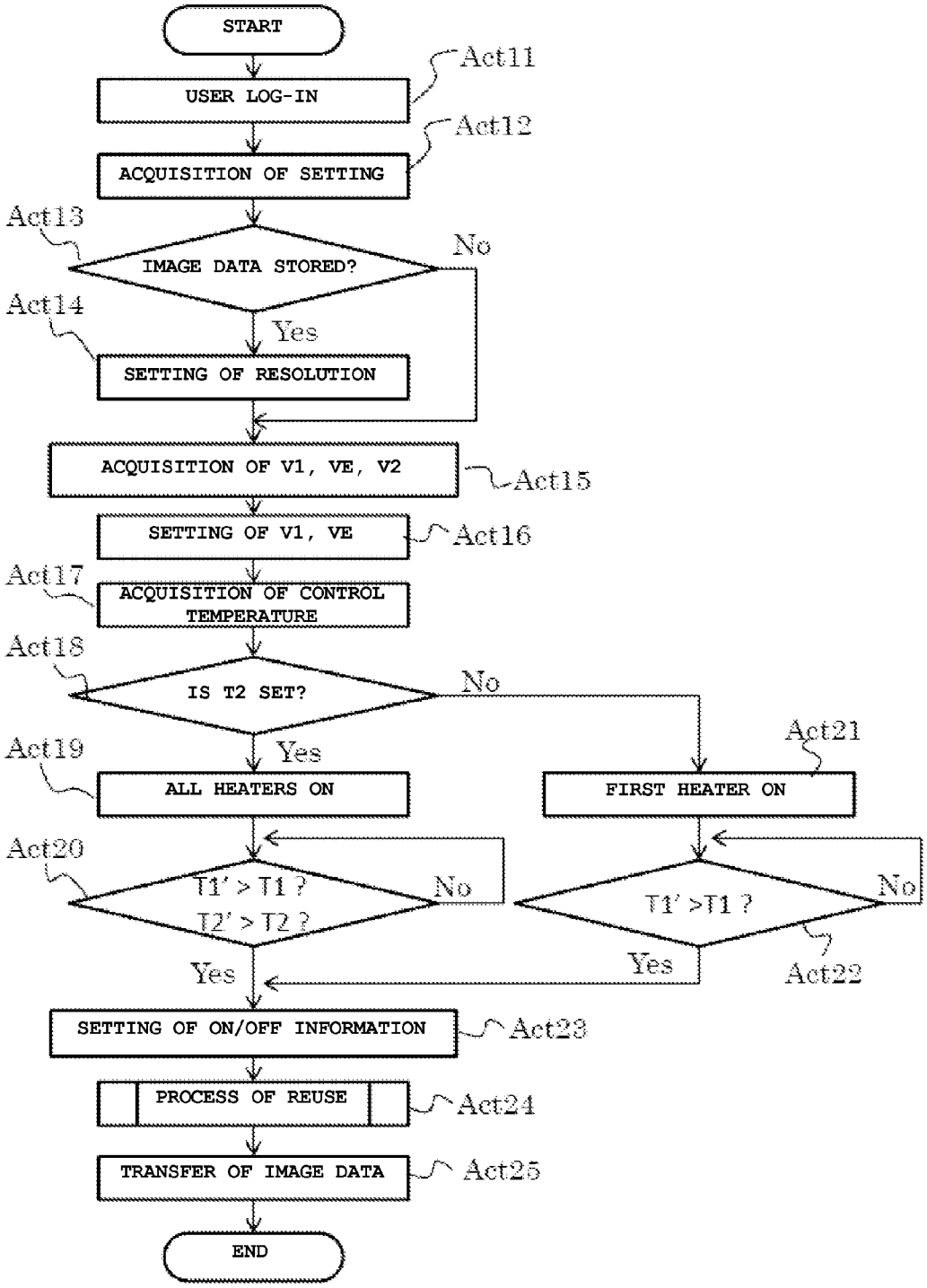
FIG. 10 is a flow chart illustrating an operation of the decoloring system in the first embodiment.

FIG. 10 is a flowchart illustrating an operation of the decoloring system 1. As the user ID is input from the operation panel 9, the controller 80 starts the operation of the decoloring system 1 (Act 1). The controller 80 has the setup screen image 120 displayed on the touch panel display 84. The user can use the operation panel 9 to select the button on the setup screen image 120. As the user presses the start button on the setup screen image 120, and the controller 80 acquires the setup information selected by the user (Act 12).

The controller 80 checks whether the user instructs storage of the image data (Act 13). When storage of the image data is instructed by the user by the operation panel 9, the controller 80 acquires the first resolution set at the same time, and it sets the first resolution for the scanners 5, 6 (Act 14). When the user does not instruct storage of the image data, the controller 80 sets the first resolution as "NON". The controller 80 reads the reference table 110, and it acquires the data of the V1, VE, V2 on the basis of the set first resolution (Act 15). The transporting controller 87 sets V1 for the motors M1 and M2, and sets VE for the motor M3 (Act 16).

On the basis of the setup information of one side or both sides that has been set, the controller 80 selects the reference table 111 or the reference table 112. On the basis of the set first resolution, the controller 80 acquires the control temperature data from the selected temperature reference table (Act 17). The controller 80 then checks whether the control temperature T2 is set (Act 18). When the control temperature T2 is set, the heater controller 86 starts turning on of the first, second and third heaters (Act 19).

The heater controller 86 keeps the first heater ON until the temperature T1' detected by the temperature sensor 67 exceeds the control temperature T1. The heater controller 86 keeps the second and third heaters ON until the temperature T2' detected by the temperature sensor 68 becomes over the control temperature T2.

In Act 18, when the control temperature T2 is not set, the heater controller 86 starts turning on the first heater (Act 21). The first heater is kept ON until the temperature T1' detected by the temperature sensor 67 exceeds the control temperature T1 (Act 22). When T1' and T2' become over a prescribed temperature, the controller 80 reads the ON/OFF information of the first to third heaters from the temperature reference table. The heater controller 86 determines which heater should be turned on during the decoloring process on the basis of the ON/OFF information (Act 23). When all of the information has been set, and the warming-up of the decoloring system 1 ends, and the controller 80 carries out the reuse process (Act 24). After end of all of the reuse processing, the image data generated by the scanners 5 and 6 are stored at the assigned address in the network (Act 25).

Figure 11:
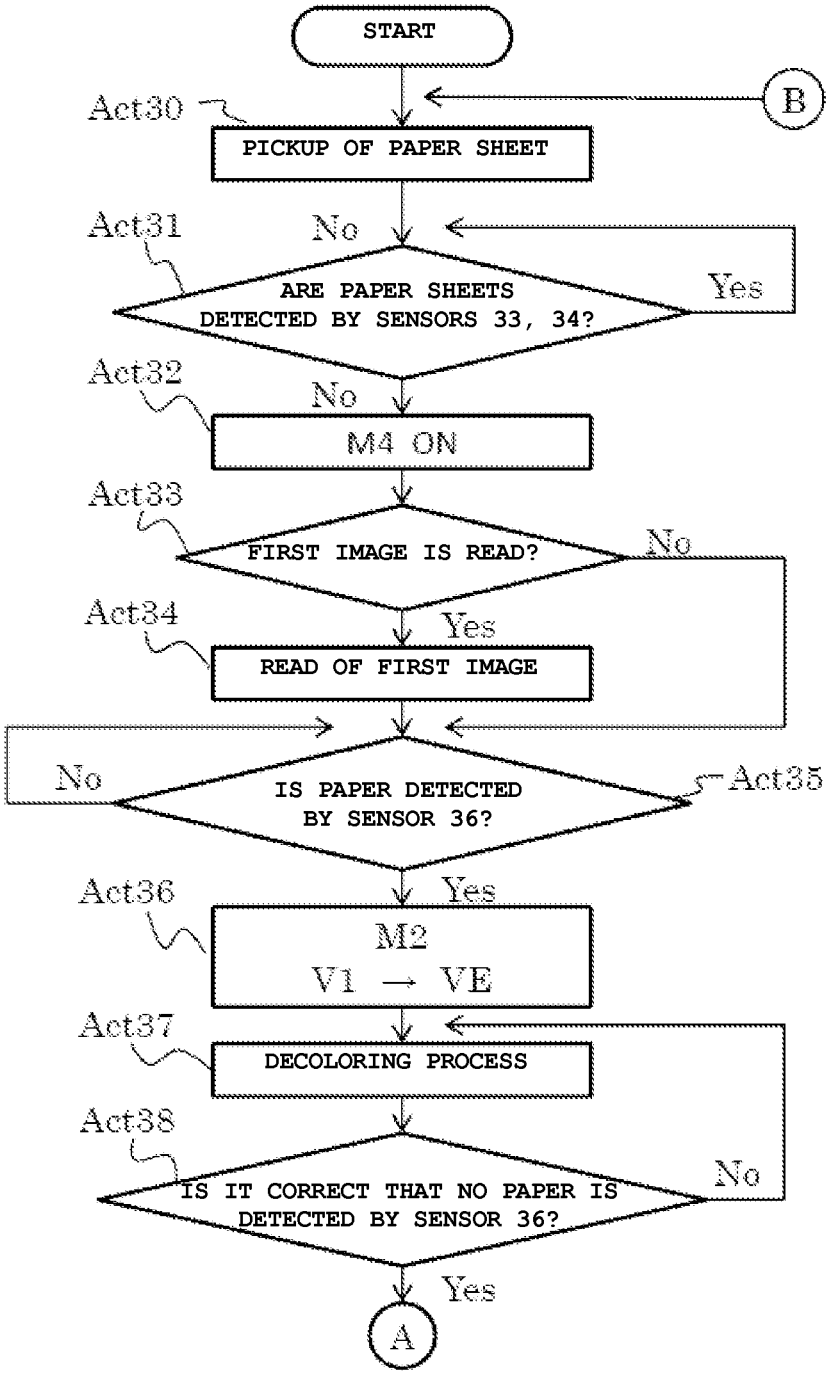
FIG. 11 is a flow chart illustrating a reuse process in the first embodiment.
Figure 12:
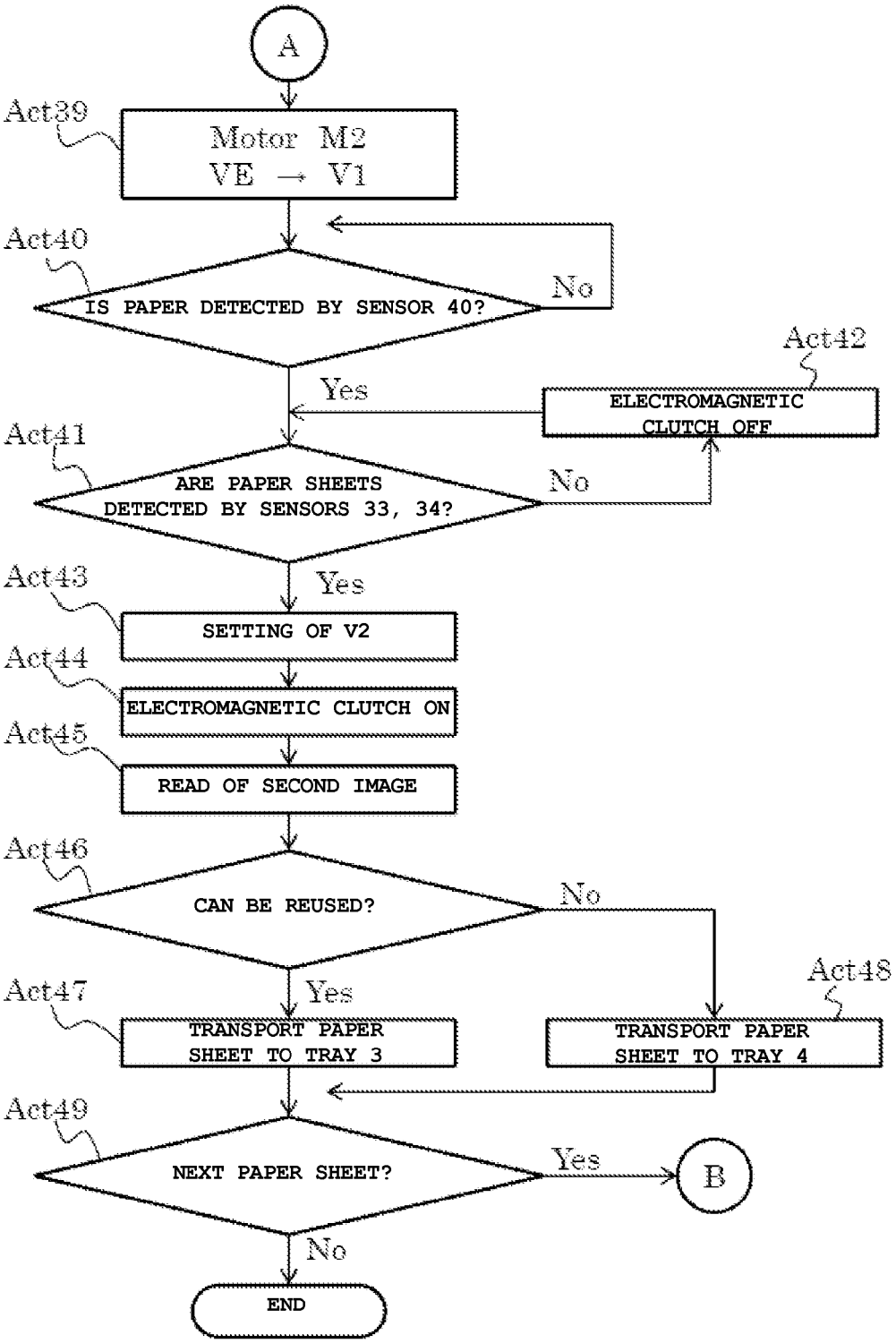
FIG. 12 is a flow chart illustrating the reuse process in the first embodiment.

FIGS. 11 and 12 are flow charts illustrating a reuse process. The reuse process is carried out for one paper sheet at a time. In practice, however, the controller 80 may carry out the same or similar processing in parallel for the various paper sheets under process.

Referring to FIG. 11 and FIG. 1, after the start of Act 24, the rollers 10, 11, and 12 (FIG. 1) rotate to pick up the paper sheet in the paper feeding tray 2, and transport it into the first transporting passage (Act 30). The transporting controller 87 (FIG. 2) checks whether the sensors 33 and 34 in the second transporting passage detect the paper sheet (Act 31). When the sensors 33 and 34 do not detect the paper sheet, the transporting controller 87 has the motor M4 turned on, and has the paper sheet in the first transporting passage transported to the second transporting passage (Act 32). The controller 80 checks whether storage of data is assigned by the setup screen image 120 (Act 33). When the user assigns storage of the image data, the scanners 5 and 6 generate the image data from both sides of the paper sheet (Act 34).

The transporting controller 87 controls so that the motor M2 is at the first read speed V1 until the front end of the paper sheet is detected by the sensor 36 (Act 35). When the sensor 36 detects the front end of the paper sheet, the transporting controller 87 controls the motor M2 so that the paper sheet transporting speed is changed to the erasing speed VE (Act 36). As the motor M2 changes the paper sheet transporting speed to the erasing speed VE, the paper sheet is transported to the decoloring unit 7, and the decoloring process is carried out (Act 37). While the sensor 36 detects the paper sheet, the motor M2 has the paper sheet transporting speed kept at VE (Act 38).

When it becomes the state in which the sensor 36 does not detect the paper sheet, the transporting controller 87 changes the motor M2 so that the speed becomes the first read speed V1 (Act 39). The transporting controller 87 waits for the paper sensor 40 to detect the front end of the paper sheet that has passed the decoloring unit 7 (Act 40). When the paper sensor 40 detects the front end of the paper sheet, the transporting controller 87 checks whether the sensors 33 and 34 detect another paper sheet (Act 41). When the sensors 33 and 34 detect another paper sheet, the transporting controller 87 turns off the electromagnetic clutch, so that the paper sheet in the third transporting passage is stopped (Act 42).

When the sensors 33 and 34 do not detect another paper sheet, the transporting controller 87 controls so that the motor M2 achieves the second read speed V2 for the sheet (Act 43). The electromagnetic clutch is changed so that it is turned on, and the paper sheet in the third transporting passage is transported to the second transporting passage. The scanners 5 and 6 generate the image data from both sides of the paper sheet at the second resolution (Act 45). The image processing section 91 analyzes this image data, and determines whether the paper sheet can be reused (Act 46).

When the paper sheet can be reused, the paper sheet is transported to the paper discharging tray 3 (Act 47). When the paper sheet cannot be reused, the paper sheet is transported to the paper discharging tray 4 (Act 48). When there is a paper sheet in the paper feeding tray 3, the controller 80 returns to Act 30. When there is no paper sheet in the paper feeding tray 3, the controller 80 sends the image generated by the scanners 5 and 6 to the assigned address on the network, and the entire process comes to an end.

The decoloring system 1 in the first embodiment can control to have the optimum paper sheet transporting speed and the temperature of the heating rollers on the basis of the presence of the image data and the resolution set by the user. As the paper sheet is not excessively heated, it is possible to cut the power consumption. Also, it is possible to alleviate the adverse influence of the heat of the paper sheet on the scanners.

According to the first embodiment, the controller 80, the heater controller 86, and the transporting controller 87 in the decoloring system 1 work together to control the decoloring system 1. The various functions of these controllers can be also carried out under control of one controller. Also, one may also adopt a configuration wherein the various functions are executed by the plurality of controllers including the server 95 and other controllers in the network and the controllers in the decoloring system 1.

The various functions may also be carried out by ASIC or other hardware circuit, and they may also be carried out by the program executed by the CPU in the controller.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for decoloring a printed image on a sheet using heat, comprising a first transporting path having at least a first image unit therealong a second transporting path positioned at the terminus of the first transporting path a heating unit located along the second transporting path, the second transporting path extending from the terminus of the first transporting path to a position of the first transporting path located in a transport direction position upstream of the first image unit;

the first image unit capable of detecting the presence of an image on the same sheet both before and after decoloring of the image; and a controller having a memory associated therewith, wherein the controller, in conjunction with the memory, sets a parameter of the decoloring apparatus based upon a desired property of the decoloring operation on a sheet.

2. The apparatus of claim 1, further wherein the desired property is the speed of the transportation of the sheet through the heating unit.

3. The apparatus of claim 1, wherein the desired property is the temperature of the heating unit.

4. The apparatus of claim 1, wherein the parameter is the dpi setting of the imaging unit.

5. The apparatus of claim 1, further including:

a second imaging unit located in the first transporting path; and a second heating unit located in the second conduction path.

6. The apparatus of claim 1, further including:

a third transporting path, extending from the intersection of the first conducting path and second conducting path at a position on the first conducting path downstream, in a paper from direction, from the first imaging unit; and a switchable gate configured to direct a sheet to the third transporting path or the second transporting path based on a property of the sheet.

7. The apparatus of claim 6, further including a first receiving tray and a second receiving tray located along the third transport path, and a sheet travelling in the third travelling path is placed in one of the first or second discharge trays based upon a property thereon determined by the controller based on information about the sheet from an image unit.

8. The apparatus of claim 1, wherein the controller sets the speed of the sheet passing through the image unit based on the status of the sheet as colored or decolored.

9. The apparatus of claim 1, wherein the parameter is selected from a look-up table in memory.

10. The apparatus of claim 1, wherein the parameter is selected by an equipment user.

11. The apparatus of claim 1, wherein the controller sends the image data generated by the first image unit to an external device.

12. The apparatus of claim 1, wherein the parameter is a first resolution of the image and a second resolution of the image read at the image section, and, when the second resolution is set to be higher than the first resolution, the controller sets the transporting speed of the paper sheet by the first transporting mechanism and the second transporting mechanism at different speeds.

13. A control method of a decoloring apparatus having a scanner for reading an image on a paper sheet and a decoloring unit for decoloring the image, comprising:

receiving a condition of the image on the paper sheet to be read by a scanner;

on the basis of the read condition, setting a read transporting speed for transporting the paper sheet to the scanner, a decoloring transporting speed for transporting the paper sheet, which has been transported to the scanner, to the decoloring unit, and a temperature at which the decoloring unit heats the paper sheet;

according to the received read condition, generating image data from the image on the paper sheet; and decoloring the image on the paper sheet at the temperature.

14. The control method according to claim 13, further comprising:

generating image data for the surface of the paper sheet after discoloration of the image, and determining whether the paper sheet can be reused.

15. The control method according to claim 13, further comprising:

sending the generated image data to an external device.

16. The control method according to claim 13, wherein the read condition of the image contains a resolution of the image data generated by the scanner.

17. The control method according to claim 16, wherein when the second resolution higher than the first resolution is set as the image read condition, the read transporting speed and the decoloring transporting speed are set slower and the heating temperature is set lower than those comparing to the first resolution.

18. The control method according to claim 13, wherein the image read condition contains information indicating whether the image data are generated by the scanner; and when the read condition with generation of the image data is set, compared with the case when the read condition without generation of the image data is set, the read transporting speed and the decoloring transporting speed are set lower, and the heating temperature is also set lower.

19. An apparatus for erasing an image on a sheet, which is capable of being erased by application of temperature to the image, comprising:

an imaging unit having a first variable speed feeding apparatus associated therewith;

an erasing section, having a second variable speed sheet feeding mechanism associated therewith; and a controller operatively coupled to at least the imaging unit, the first variable speed feeding apparatus associated therewith, the erasing unit, and the second variable speed sheet feeding mechanism associated therewith, wherein the controller includes a plurality of associations of erasing temperature, image resolution and sheet movement speeds associated therewith, and an association is used for the selection of a speed for the first and the second variable speed feeding apparatuses, an image resolution, and a temperature for erasing an image.

20. The apparatus of claim 19, wherein the association is maintained in a look-up table.

* * * * *